US009835356B1

(12) United States Patent
Wegner et al.

(10) Patent No.: US 9,835,356 B1
(45) Date of Patent: Dec. 5, 2017

(54) FLUID HEATING APPARATUS UTILIZING AT LEAST TWO FLUID PATHS

(71) Applicants: Mark Wegner, Sioux Falls, SD (US); Brad Hyronimus, Beresford, SD (US); John W. Finger, Beresford, SD (US)

(72) Inventors: Mark Wegner, Sioux Falls, SD (US); Brad Hyronimus, Beresford, SD (US); John W. Finger, Beresford, SD (US)

(73) Assignee: Sioux Corporation, Beresford, SD (US)

( * ) Notice: Subject to any disclaimer, the term of this patent is extended or adjusted under 35 U.S.C. 154(b) by 280 days.

(21) Appl. No.: 14/615,893

(22) Filed: Feb. 6, 2015

(51) Int. Cl.
*F24H 1/14* (2006.01)
*F24H 1/34* (2006.01)

(52) U.S. Cl.
CPC ..... *F24H 1/145* (2013.01); *F24H 1/34* (2013.01)

(58) Field of Classification Search
CPC ..... F24H 1/45; F24H 1/354
See application file for complete search history.

(56) References Cited

U.S. PATENT DOCUMENTS 2,515,490 A * 7/1950 Briggs ..... G05D 23/1393 165/298
4,203,392 A * 5/1980 McLane ..... F22B 9/02 122/134
4,222,350 A * 9/1980 Pompei ..... F24H 1/52 122/32
5,020,721 A * 6/1991 Horne ..... F24H 1/186 122/14.3
7,735,458 B2 * 6/2010 Stapensea ..... F24D 17/00 122/20 R
8,322,313 B2 * 12/2012 Yamaoka ..... F24H 1/186 122/14.22
8,490,582 B1 * 7/2013 Wingen ..... F22B 1/1807 122/406.1
8,584,625 B2 * 11/2013 Ando ..... F24H 1/186 122/20 R
2005/0133202 A1 * 6/2005 Jorgensen ..... F28D 7/024 165/103
2009/0064945 A1 * 3/2009 Amada ..... F24H 1/43 122/15.1

OTHER PUBLICATIONS

Parallel flow path analysis, 2012.*

* cited by examiner

*Primary Examiner* — Nathaniel Herzfeld
(74) *Attorney, Agent, or Firm* — Jeffrey A Proehl; Woods, Fuller, Shultz & Smith, P.C.

(57) ABSTRACT

A fluid heater for a heating fluid and having a fluid inlet and a fluid outlet may comprise a heater housing defining an interior with a combustion chamber being positioned in the interior of the housing, and fluid tubing in the interior of the housing and adjacent to the combustion chamber, with the fluid tubing defining a fluid path through the housing between the fluid inlet and the fluid outlet. The heater may also include a burner configured to combust a fuel in the combustion chamber to heat the fluid tubing. At least a portion of the fluid path may comprise a bifurcated fluid path between the fluid inlet and the fluid outlet.

18 Claims, 2 Drawing Sheets

FLUID HEATING APPARATUS UTILIZING AT LEAST TWO FLUID PATHS

BACKGROUND

Field

The present disclosure relates to fluid heaters and more particularly pertains to a new fluid heating apparatus utilizing at least two fluid paths for facilitating heating of fluid at higher flow rates.

SUMMARY

In one aspect, the present disclosure relates to a fluid heater for a heating fluid and having a fluid inlet and a fluid outlet. The fluid heater may comprise a heater housing defining an interior with a combustion chamber being positioned in the interior of the housing, and fluid tubing in the interior of the housing and adjacent to the combustion chamber, with the fluid tubing defining a fluid path through the housing between the fluid inlet and the fluid outlet. The fluid heater may also comprise a burner configured to combust a fuel in the combustion chamber to heat the fluid tubing. At least a portion of the fluid path may comprise a bifurcated fluid path between the fluid inlet and the fluid outlet.

In another aspect, the disclosure relates to a fluid heating system comprising a reservoir having an interior configured to hold a fluid, and the reservoir having a reservoir inlet and a reservoir outlet. The system also comprising a fluid heater for a heating fluid and having a fluid inlet in fluid communication with the interior of the reservoir and a fluid outlet in communication with the interior of the reservoir. The fluid heater may comprise a heater housing defining an interior with a combustion chamber being positioned in the interior of the housing, and fluid tubing in the interior of the housing and adjacent to the combustion chamber, with the fluid tubing defining a fluid path through the housing between the fluid inlet and the fluid outlet. The fluid heater may also comprise a burner configured to combust a fuel in the combustion chamber to heat the fluid tubing. At least a portion of the fluid path may comprise a bifurcated fluid path between the fluid inlet and the fluid outlet.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
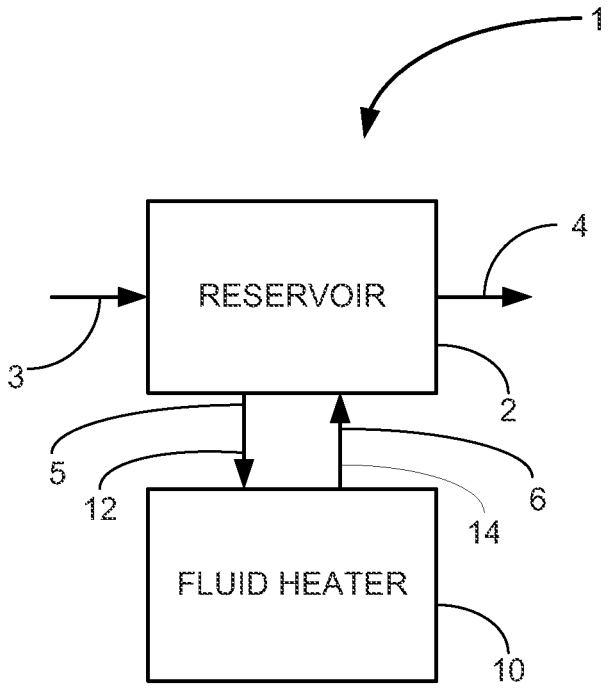
FIG. 1 is a schematic diagram of a system including a fluid heating apparatus utilizing at least two fluid paths according to the present disclosure.
Figure 2:
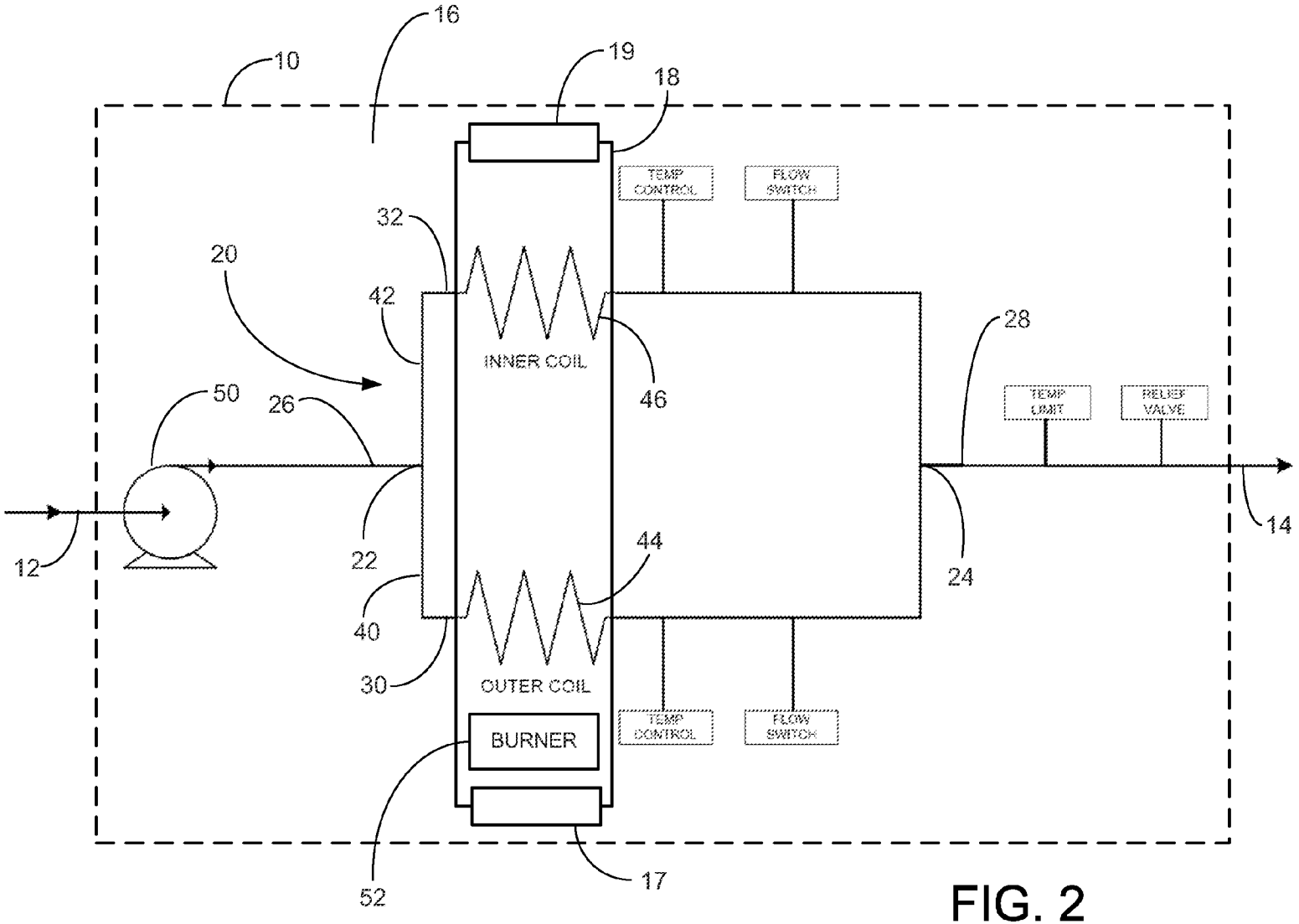
FIG. 2 is a schematic diagram of the fluid heating apparatus, according to an illustrative embodiment.

With reference now to the drawings, and in particular to FIGS. 1 and 2 thereof, a new fluid heating apparatus utilizing at least two fluid paths embodying the principles and concepts of the disclosed subject matter will be described.

Applicants have recognized that a typical fluid heater may include a heat exchanger coil of tubing which defines a single flow or fluid path through the fluid heater such that fluid entering an inlet of the fluid heater has a single path to pass through to reach the fluid outlet of the fluid heater. Such a design may have problems handling relatively higher volumetric flow rates. The fluid flow rate handled by a fluid heater can be increased by speeding up the velocity of the fluid through the heat exchanger, but maximizing the fluid velocity through the heat exchanger can have at least two detrimental effects. The pressure drop through the coil would be substantially more (e.g., twice as much), and therefore require a larger (and thus more expensive) pump that would be able to produce the required pressure to overcome the greatly increased pressure drop. Another problem is if the fluid velocity is too high, the fluid will erode the wall of the tube and fail prematurely.

In recognition of these problems, applicants have developed a fluid heater in which a bifurcated fluid path extends through at least a portion of the heat exchanger which effectively allows for a higher flow rate through the heat exchanger without significantly increasing the velocity of the fluid, and thus can avoid significant extension of the length of the fluid path and avoid some of the tubing erosion caused by higher fluid velocities.

In one aspect, the disclosure is directed to a system 1 in which a reservoir 2 is employed to hold a relatively large amount of fluid in reserve for use in a short period of time. Such applications include, for example, reservoirs used for holding a large quantity of water for use in mixing batch of concrete at a ready mix plant, in which a large of amount of water needs to be added to the cement and aggregate mix in a relatively short time period as the concrete is produced. The fluid may be introduced into the reservoir 2 through a reservoir inlet 3 from a fluid source, and may be drawn from the reservoir through a reservoir outlet 4. A fluid heater 10 may be utilized to heat and maintain the temperature level of the fluid in the reservoir 2 through interchange lines 5, 6 that permit the exchange of fluid from the reservoir to the fluid heater and from the fluid heater to the reservoir.

In another aspect, the disclosure is directed to the fluid heater 10 for heating fluid passing through the heater. The fluid heater 10 may have a fluid inlet 12 into which fluid to be heated is introduced into the apparatus, and a fluid outlet 14 from which heated fluid is dispensed from the apparatus. In a system 1, the interchange line 5 may be connected to the fluid inlet 12 and the fluid outlet may be connected to the interchange line 6. Generally, fluid to be heated flows into the inlet 12, flows from the inlet 12 to the outlet 14, and then flows out of the outlet 14. The fluid inlet 12 is upstream of the fluid outlet 14, and conversely the fluid outlet is downstream of the fluid inlet.

In some embodiments, the fluid heater 10 includes a heater housing 16 which may define an interior of the housing, and the interior may be surrounded by a perimeter wall 18 which may be generally cylindrical in shape. The heater housing may have an intake opening 17 for generally receiving air to be used in fuel combustion and an exhaust opening 19 through which exhaust gases from the fuel combustion is able to exit the interior of the heater housing 16. A combustion chamber may be positioned in the interior of the housing, and in some embodiments the chamber is generally centrally located in the interior.

The fluid heater 10 may also include fluid tubing for defining a fluid path through the heater and the housing between the fluid inlet 12 and the fluid outlet 14. Significantly, the fluid tubing of the fluid heater may be configured so that at least a portion of the fluid path comprises a bifurcated fluid path 20 between the fluid inlet 12 and the fluid outlet 14. The bifurcated fluid path 20 may extend from an inlet juncture 22 to an outlet juncture 24. The inlet juncture 22 may not correspond to the fluid inlet 12 of the heater, and an inlet tube 26 may extend from the fluid inlet 12 to the inlet juncture 22. Similarly, the outlet juncture 24 may not correspond to the fluid outlet 14 of the heater 10, and an outlet tube 28 may extend from the outlet juncture 24 to the fluid outlet 14. A fluid inlet flow may be carried in the inlet tube 26 from the inlet 12 to the inlet juncture and may be divided at the inlet juncture 22. A fluid outlet flow may be collected or combined at the outlet juncture 24 to be carried in the outlet tube 28 to the outlet 14. The inlet fluid flow and the outlet fluid flow may be singular or unified fluid flows, and in many applications the outlet fluid flow will be substantially equal to the inlet fluid flow.

The bifurcated fluid path 20 may include at least two fluid subpaths and illustratively may include a first subpath 30 and a second subpath 32. The first subpath 30 and the second subpath 32 may each extend from the inlet juncture 22 to the outlet juncture 24 in a parallel configuration. (It should be recognized that for the purposes of this description, the term "parallel" is not intended to mean or require a parallel quality in the geometric sense between paths or tubes, and instead is intended to generally mean that the paths or tubes have common beginning points and end points between which both extend.) A first fluid flow may move through the first subpath 30 and a second fluid flow may move through the second subpath 32. The first fluid flow does not move through the second subpath and similarly the second fluid flow does not move through the first subpath. The first and second fluid flows are thus parallel to and separate of each other between the junctures.

The first subpath 30 may be defined by a first conduit 40 and a second subpath 32 may be defined by a second conduit 42. The first conduit 40 may be formed into a first coil 44, and the second conduit 42 may be formed into a second coil 46. The fluid tubing of the first 40 and second 42 conduits may be positioned in or adjacent to the combustion chamber in the housing. In some embodiments, the second coil 46 may be nested inside the first coil 44 although other configurations of the first conduit 40 and second conduit 42 may be utilized. The first conduit 40 may have a first length between the inlet juncture 22 and the outlet juncture 24, and similarly the second conduit 42 may have a second length measured between the inlet juncture and outlet juncture. In some embodiments, the second length of the second conduit may be substantially equal, and in some embodiments the second length may be less or shorter than the first length of the first conduit 40. The first 44 and second 46 coils may extend about a central axis of the housing. In some embodiments, the coils 44, 46 are centered on at least a portion of the combustion chamber of the housing. During operation of the fluid heater 10, the fluid inlet flow from the inlet tube 26 may be divided at the inlet juncture 22 into the first fluid flow which flows into the first subpath 30 and the second fluid flow which flows into the second subpath 32. The first fluid flow from the first subpath 30 and the second fluid flow from the second subpath 32 may be combined together at the outlet juncture 24 into the fluid outlet flow in the outlet tube 28.

The fluid heater 10 may also include a fluid pump 50 which is configured to move fluid along the fluid path through the heater ends and more specifically through the bifurcated fluid path 20. In some embodiments, the fluid pump 50 may be in communication with the fluid path upstream of the bifurcated fluid path 20 and may be in communication with the fluid path at the inlet tube 26 in order to pump or push fluid through the fluid path prior to the fluid passing through the conduits 40, 42 adjacent or in the combustion chamber.

The fluid heater 10 may also include a burner 52 which is configured to combust a fuel to generate combustion exhaust gases to move along an exhaust gas movement path generally located between the intake opening and the exhaust opening of the housing. The burner 52 may generally be configured to direct combustion exhaust gases about the fluid tubing, and may be configured to direct the combustion exhaust gas through the center of the coils 44, 46 in order to heat the material forming the coils as well as the fluid contained within the coils. In some embodiments, a portion of the exhaust gas movement path extends through a center of the coils 42, 44, and may also be directed to paths about the exterior or outside of the coils.

Other elements may be included in the heater 10, including a temperature control device for at least one, and optionally both, of the fluid subpaths 30, 32, and may be connected to the respective conduits 40, 42 for sensing the condition of the respective first and second fluid flows. A flow switch device may be provided for at least one, and optionally both, of the subpaths 30, 32, and may also be connected to the respective conduits 40, 42 for sensing the condition of the respective first and second fluid flows. A temperature limiting device may be provided for the heater 10, and may be in communication with the flow path such as at the outlet tube to sense the temperature of the fluid outlet flow. A relief valve device may be provided for the heater 10, and may be in communication with the flow path at a location such as at the outlet tube to sense the pressure of the fluid outlet flow, and relieve a pressure condition that exceeds predetermined limits.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A fluid heater for a heating fluid and having a fluid inlet and a fluid outlet, the fluid heater comprising:

a heater housing defining an interior with a combustion chamber being positioned in the interior of the housing;

fluid tubing in the interior of the housing and adjacent to the combustion chamber, the fluid tubing defining a fluid path through the housing between the fluid inlet and the fluid outlet; and a burner configured to combust a fuel in the combustion chamber to heat the fluid tubing;

wherein at least a portion of the fluid path comprises a bifurcated fluid path between the fluid inlet and the fluid outlet; and wherein the bifurcated fluid path extends from an inlet juncture to an outlet juncture, the inlet juncture dividing fluid flow on the fluid path into at least two fluid flows on at least two fluid subpaths with a first subpath and a second subpath each extending from the inlet juncture to the outlet juncture and the outlet juncture collecting the at least two fluid flows in the bifurcated fluid path into a single fluid flow; and wherein the bifurcated fluid path between the inlet and outlet junctures is characterized by being free of devices producing pressure drops and velocity increases in the fluid passing through the bifurcated fluid path;

temperature control devices in communication with each of the fluid subpaths and configured to sense a temperature of fluids on each of the first and second fluid subpaths;

flow switch devices in communication with each of the fluid subpaths and configured to sense a flow of fluid through each of the first and second fluid subpaths;

a temperature limiting device in communication with the fluid path and configured to sense the temperature of fluid at the fluid outlet; and a relief valve device in communication with the fluid path and configured to sense the pressure of fluid at the fluid outlet and relieve a pressure condition that exceeds a predetermined limit.

2. The heater of claim 1 wherein the inlet juncture and the outlet juncture are located exterior of the heater housing.

3. The heater of claim 1 wherein the fluid tubing includes an inlet tube extending from the fluid inlet to the inlet juncture and comprising a single conduit, a fluid inlet flow carried in the inlet tube being divided at the inlet juncture; and an outlet tube extending from the outlet juncture to the fluid outlet and comprising a single conduit, a fluid outlet flow carried in the outlet tube being a combination of flows from the bifurcated flow path from the outlet juncture.

4. The heater of claim 1 wherein a first fluid flow moves through the first subpath and a second fluid flow moves through the second subpath, the first fluid flow not moving through the second subpath and the second fluid flow not moving through the first subpath.

5. The heater of claim 1 wherein the first subpath is defined by a first conduit and the second subpath is defined by a second conduit, the first and second conduits extending from the inlet juncture to the outlet juncture.

6. The heater of claim 5 wherein the first conduit is formed into a first coil and the second conduit is formed into a second coil.

7. The heater of claim 6 wherein the second coil is positioned adjacent to the first coil.

8. The heater of claim 6 wherein the first coil has a first length between the inlet juncture and the outlet juncture and the second coil has a second length between the inlet juncture and the outlet juncture, the second length being less than the first length.

9. The heater of claim 1 additionally comprising a fluid pump configured to move fluid along the bifurcated fluid path.

10. A fluid heating system comprising:

a reservoir having an interior configured to hold a fluid, the reservoir having a reservoir inlet and a reservoir outlet; and a fluid heater for a heating fluid and having a fluid inlet in fluid communication with the interior of the reservoir and a fluid outlet in communication with the interior of the reservoir, the fluid heater comprising:

a heater housing defining an interior with a combustion chamber being positioned in the interior of the housing;

fluid tubing in the interior of the housing and adjacent to the combustion chamber, the fluid tubing defining a fluid path through the housing between the fluid inlet and the fluid outlet; and a burner configured to combust a fuel in the combustion chamber to heat the fluid tubing;

wherein at least a portion of the fluid path comprises a bifurcated fluid path between the fluid inlet and the fluid outlet;

wherein the bifurcated fluid path extends from an inlet juncture to an outlet juncture, the inlet juncture dividing fluid flow on the fluid path into at least two fluid flows on at least two fluid subpaths with a first subpath and a second subpath each extending from the inlet juncture to the outlet juncture and the outlet juncture collecting the at least two fluid flows in the bifurcated fluid path into a single fluid flow; and wherein the bifurcated fluid path between the inlet and outlet junctures is characterized by being free of devices producing pressure drops and velocity increases in the fluid passing through the bifurcated fluid path;

temperature control devices in communication with each of the fluid subpaths and configured to sense a temperature of fluids on each of the first and second fluid subpaths;

flow switch devices in communication with each of the fluid subpaths and configured to sense a flow of fluid through each of the first and second fluid subpaths;

a temperature limiting device in communication with the fluid path and configured to sense the temperature of fluid at the fluid outlet; and a relief valve device in communication with the fluid path and configured to sense the pressure of fluid at the fluid outlet and relieve a pressure condition that exceeds a predetermined limit.

11. The system of claim 10 wherein the inlet juncture and the outlet juncture are located exterior of the heater housing.

12. The system of claim 10 wherein fluid tubing includes an inlet tube extending from the fluid inlet to the inlet juncture and comprising a single conduit, a fluid inlet flow carried in the inlet tube being divided at the inlet juncture; and an outlet tube extending from the outlet juncture to the fluid outlet and comprising a single conduit, a fluid outlet flow carried in the outlet tube being a combination of flows from the bifurcated flow path from the outlet juncture.

13. The system of claim 10 wherein a first fluid flow moves through the first subpath and a second fluid flow moves through the second subpath, the first fluid flow not moving through the second subpath and the second fluid flow not moving through the first subpath.

14. The system of claim 10 wherein the first subpath is defined by a first conduit and the second subpath is defined by a second conduit, the first and second conduits extending from the inlet juncture to the outlet juncture.

15. The system of claim 14 wherein the first conduit is formed into a first coil and the second conduit is formed into a second coil.

16. The system of claim 15 wherein the second coil is positioned adjacent to the first coil.

17. The system of claim 15 wherein the first coil has a first length between the inlet juncture and the outlet juncture and the second coil has a second length between the inlet juncture and the outlet juncture, the second length being less than the first length.

18. A fluid heater for a heating fluid and having a fluid inlet and a fluid outlet, the fluid heater comprising:

a heater housing defining an interior with a combustion chamber being positioned in the interior of the housing;

fluid tubing in the interior of the housing and adjacent to the combustion chamber, the fluid tubing defining a fluid path through the housing between the fluid inlet and the fluid outlet; and a burner configured to combust a fuel in the combustion chamber to heat the fluid tubing;

a fluid pump configured to move fluid along the fluid path;

wherein at least a portion of the fluid path comprising a bifurcated fluid path between the fluid inlet and the fluid outlet; and wherein the bifurcated fluid path extends from an inlet juncture to an outlet juncture, the inlet juncture dividing fluid flow on the fluid path into at least two fluid flows on at least two fluid subpaths with a first subpath and a second subpath each extending from the inlet juncture to the outlet juncture and the outlet juncture collecting the at least two fluid flows in the bifurcated fluid path into a single fluid flow; and wherein the bifurcated fluid path between the inlet and outlet junctures is characterized by being free of flow restricting structures producing pressure drops and velocity increases in the fluid passing through the bifurcated fluid path;

wherein the first subpath is defined by a first conduit and the second subpath is defined by a second conduit, the first and second conduits extending from the inlet juncture to the outlet juncture;

wherein the first conduit is formed into a first coil and the second conduit is formed into a second coil;

wherein the second coil is positioned adjacent to the first coil;

wherein the first coil has a first length between the inlet juncture and the outlet juncture and the second coil has a second length between the inlet juncture and the outlet juncture, the second length being less than the first length;

temperature control devices in communication with each of the fluid subpaths and configured to sense a temperature of fluids on each of the first and second fluid subpaths;

flow switch devices in communication with each of the fluid subpaths and configured to sense a flow of fluid through each of the first and second fluid subpaths;

a temperature limiting device in communication with the fluid path and configured to sense the temperature of fluid at the fluid outlet; and a relief valve device in communication with the fluid path and configured to sense the pressure of fluid at the fluid outlet and relieve a pressure condition that exceeds a predetermined limit.

* * * * *